US006095408A

United States Patent [19]

Nguyen

[11] Patent Number: 6,095,408

[45] Date of Patent: Aug. 1, 2000

[54] ONE-PIECE MULTIPLE-COMPARTMENT SHIPPING AND DISPLAY BOX

[75] Inventor: Dat K. Nguyen, San Jose, Calif.

[73] Assignee: Adaptec, Inc., Milpitas, Calif.

[21] Appl. No.: 09/119,716

[22] Filed: Jul. 20, 1998

[51] Int. Cl.[7] ..... B65D 25/04

[52] U.S. Cl. ..... 229/120.21; 229/167; 229/121; 229/150

[58] Field of Search ..... 229/120.21, 167, 229/168, 121, 227, 247, 150, 151

[56] References Cited

U.S. PATENT DOCUMENTS

| | | | |
|---|---|---|---|
| 1,494,234 | 1/1924 | Frankenstein | 229/167 X |
| 1,628,763 | 2/1927 | Frankenstein | 229/167 |
| 1,791,196 | 2/1931 | Deutschmeister | 229/149 X |
| 2,118,821 | 5/1938 | Ringler | 229/168 X |
| 2,132,957 | 10/1938 | Mahone | 229/125.25 |
| 2,303,264 | 11/1942 | Flick | 229/112 X |
| 2,308,818 | 1/1943 | Levkoff | 229/167 |
| 2,397,934 | 4/1946 | Frankenstein | 229/167 X |
| 2,447,243 | 8/1948 | Freel et al. | 229/167 |
| 2,464,951 | 3/1949 | Stengren | 229/167 X |
| 2,614,746 | 10/1952 | Frankenstein | 229/167 X |
| 2,860,823 | 11/1958 | Frankenstein | 229/167 |
| 2,874,154 | 8/1959 | Frankenstein | 229/167 X |
| 2,996,175 | 8/1961 | Frankenstein | 229/112 X |
| 4,285,150 | 8/1981 | Richardson et al. | 229/150 X |
| 4,488,675 | 12/1984 | von Gnechten et al. . | |
| 4,618,090 | 10/1986 | Cortellucci . | |
| 4,919,269 | 4/1990 | Wright et al. . | |
| 5,242,071 | 9/1993 | Goebel . | |
| 5,289,971 | 3/1994 | McClure . | |
| 5,323,958 | 6/1994 | Liu et al. . | |
| 5,326,017 | 7/1994 | Liu et al. . | |
| 5,332,148 | 7/1994 | Liu et al. . | |
| 5,588,583 | 12/1996 | Cargile, Jr. . | |
| 5,871,147 | 2/1999 | Smith et al. | 229/167 |

*Primary Examiner*—Stephen P. Garbe
*Assistant Examiner*—Tri M. Mai
*Attorney, Agent, or Firm*—Gunnison, McKay & Hodgson, LLP; Serge J. Hodgson

[57] ABSTRACT

A multiple compartment shipping and display box includes a plurality of compartments and is made from a single piece of material. The box includes two channel-beam structures that are used to form two end compartments. A shelf extends between the two-channel-beam structures and defines two more compartments. A box beam extends between the two channel-beam structures, and has a portion of the shelf as one side of the beam. The interior volume of the box beam provides yet another compartment. In addition to defining the various compartments, the channel-beam structures and the box beam provide rigidity and strength to the box. Also, three strips are each glued to a different side wall of the box to provide additional strength and rigidity. All of the components in the box are formed from a single piece of die-cut material.

5 Claims, 12 Drawing Sheets

ONE-PIECE MULTIPLE-COMPARTMENT SHIPPING AND DISPLAY BOX

BACKGROUND OF THE INVENTION

1. Field of the Invention

This invention relates generally to packaging, and in particular to boxes used to ship and display electronic circuit boards.

2. Description of Related Art

Various types of boxes are in use for shipping and displaying electronic circuit boards and related parts. Typically, since the boxes require multiple compartments, the boxes are made from multiple pieces of material. While use of multiple pieces of material results in a useful box, the multiple pieces require costly and difficult processes to construct the box. In addition, a sleeve is typically placed around the box. Information concerning the product contained in the box is printed on the sleeve.

There are several examples of one-piece containers in the prior art. For example, U.S. Pat. No. 4,618,090 entitled "One Piece Double Shell Box with Closure Fastener" of Cortellucci issued on Oct. 21, 1986 discloses a one piece shoe box 100 (FIGS. 1A and 1B). In a closed position, box 100 is a single large compartment that is held together by a lid 105. When lid 105 is lifted, box 100 unfolds to form two compartments 101 and 102. However, it is in only the open unfolded state that two compartments exist.

Another example of a one piece box is presented in U.S. Pat. No. 4,488,675, entitled "One Piece Interlocking Outfold Container" of von Gnechten et al. issued on Dec. 18, 1984 discloses another one compartment box 200 (FIG. 2A). FIG. 2B illustrates the flat cardboard cutout used to construct box 200.

U.S. Pat. Nos. 5,323,958, 5,588,583, 5,332,148, 5,326,017 and 4,919,269 show different one-piece containers with multiple compartments. However, none of these containers is suitable for use with an electronic circuit board and related components. Hence, a one-piece box having multiple compartments that permit easy access and viewing of an electronic circuit board and related parts would be desirable. The one-piece box preferably would have sufficient strength and rigidity to allow shipping and stacking of the packed boxes.

SUMMARY OF THE INVENTION

According to the principles of this invention, a one-piece container includes an interior wall having first and second sides. An exterior end wall of the one-piece container is separated from and substantially parallel to the interior wall. A plurality of exterior side walls of the one-piece container are oriented to define a first storage compartment bounded by the interior surfaces of the plurality of side walls, the first side of the interior wall, and an interior surface of the exterior end wall.

Second and third storage compartments of the one-piece container are defined by a shelf extending from the second surface of the interior wall, and perpendicular to the interior wall.

Another interior wall of the one-piece container also has first and second sides. Another exterior end wall of the one-piece container is separated from and substantially parallel to the another interior wall. The interior surfaces of the plurality of side walls, the first side of the another interior wall, and an interior surface of the another exterior end wall bound a fourth storage compartment of the one-piece container.

In one embodiment, the interior wall is a vertical section of a channel-beam structure. Similarly, the another interior wall is a vertical section of another channel-beam structure. The shelf is coupled to both of the channel-beam structures.

The one-piece container also includes a box beam that extends between the two channel-beam structures and includes a portion of the shelf as one wall of the box beam. The interior volume of the box beam is yet another compartment in the box. In addition to defining the various compartments, the channel-beam structures and the box beam provide rigidity and strength to the box. Also, three strips are each glued to a different side wall of the box to provide additional strength and rigidity. All of the components in the box are formed from a single piece of die-cut material.

In another embodiment, the one-piece container includes a first side wall; a first end wall extending from, and substantially perpendicular to the first side wall; a second end wall parallel to and separated from the first end wall, and extending from, and substantially perpendicular to the first side wall; a second side wall extending from, and substantially perpendicular to the first side wall, and perpendicular to the first and second end walls; and a box beam extending along and connected to the second side wall wherein the box beam, and the first and second end walls, the first and second side walls, and the box beam are formed from the one piece. An interior volume of the box beam is a first compartment of the one-piece container.

BRIEF DESCRIPTION OF THE DRAWING

Herein, elements with the same reference numeral are the same element. Also, the first digit of a reference numeral represents the figure number of the figure in which the element first appears.

DETAILED DESCRIPTION OF THE INVENTION

Figure 1A:
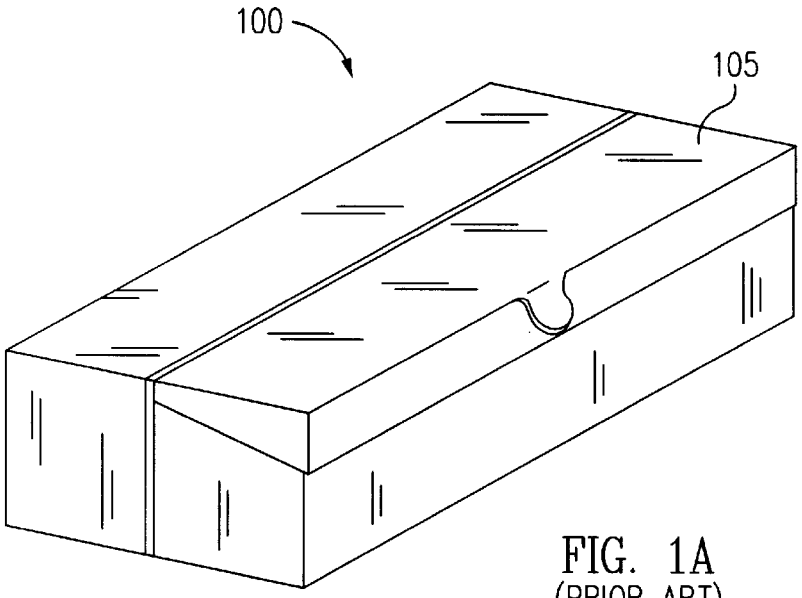
FIG. 1A (PRIOR ART)
FIG. 1A is a perspective view of a prior art closed one-piece double shell box with a closure fastener.
Figure 1B:
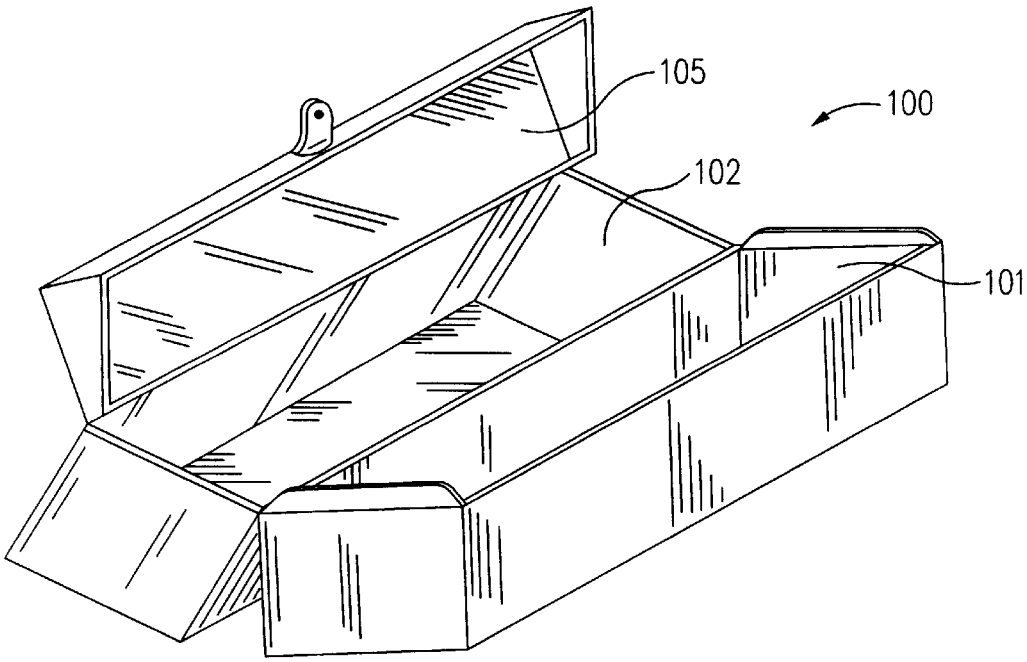
FIG. 1B (PRIOR ART)
FIG. 1B is a perspective view of the prior art box of FIG. 1A in the open position.
Figure 2B:
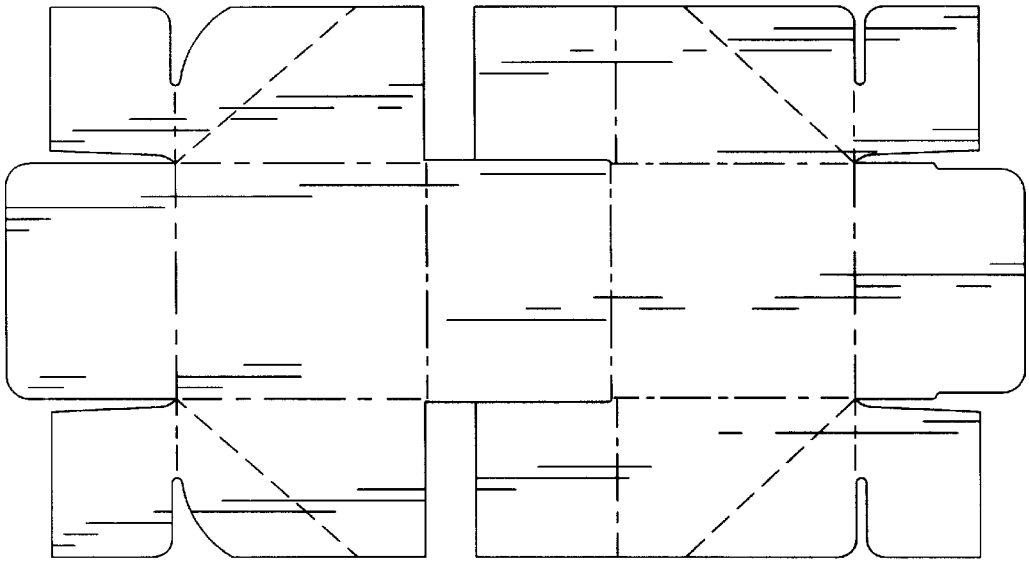
FIG. 2B (PRIOR ART)
FIG. 2B is a prior art flat cardboard cutout from which the prior art box of FIG. 2A is constructed.
Figure 2A:
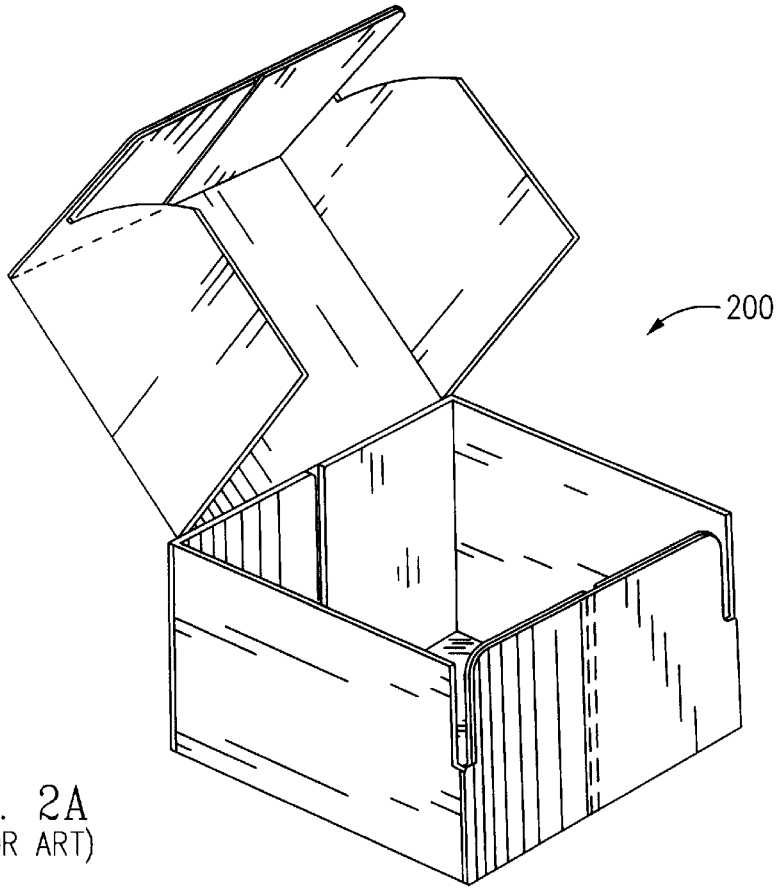
FIG. 2A (PRIOR ART)
FIG. 2A is a perspective view of a prior art one-piece interlocking outfold box.

According to the principles of this invention, a multiple compartment shipping and display box 300, sometimes referred to simply as box 300, includes a plurality of compartments 390 and 391 and is made from a single piece of material. In addition to compartments 390 and 391 box 300 includes two additional storage compartments, one at each end of box 300 that are not visible in FIG. 3A. In one embodiment, box 300 also includes a box beam that provides rigidity while at the same time providing a storage compartment inside the box beam. Hence, the one-piece box of this invention has multiple storage compartments.

Typically, an electronic circuit board is placed in compartment 390 and is held in place by first and second product positioning and box support elements and the vertical sections of channel-beam structures at the ends. All of these structures are described more completely below.

A shelf 321 bounds the top of compartment 390 and the bottom of compartment 391. Typically, manuals, CDROMs, disks, and any other printed materials associated with the electronic circuit board are placed on shelf 321.

Exterior end walls 305 and 308 can be opened to gain access to the end compartments, and to the box beam. Cables, power adapters, and other similar accessories required for use with the electronic circuit board are stored in these compartments.

When box 300 is packed, side wall 302, which is the top, is closed and closure tab 301 is placed in slot 303. Thus, the one-piece box of this invention eliminates the prior art corrugated multi-piece box that was placed inside a sleeve. Information describing the product contained in box 300 is printed directly on the outer surfaces of box 300.

The one-piece construction of box 300 makes automation of the box assembly line, as well as packing of the box, possible. Also, the one-piece design reduces storage cost because all the components and pieces needed with the circuit board are stored in box 300; reduces shipping costs because box 300 is lighter than the prior art box and sleeve while providing equivalent strength and rigidity; and reduces labor, material costs, and box material inventory. Since box 300 can be used for a wide-variety of electronic circuit boards, box 300 reduces packaging testing requirements. Thus, one-piece multiple compartment storage and display box 300 has several important advantages over the prior art configurations.

Figure 3A:
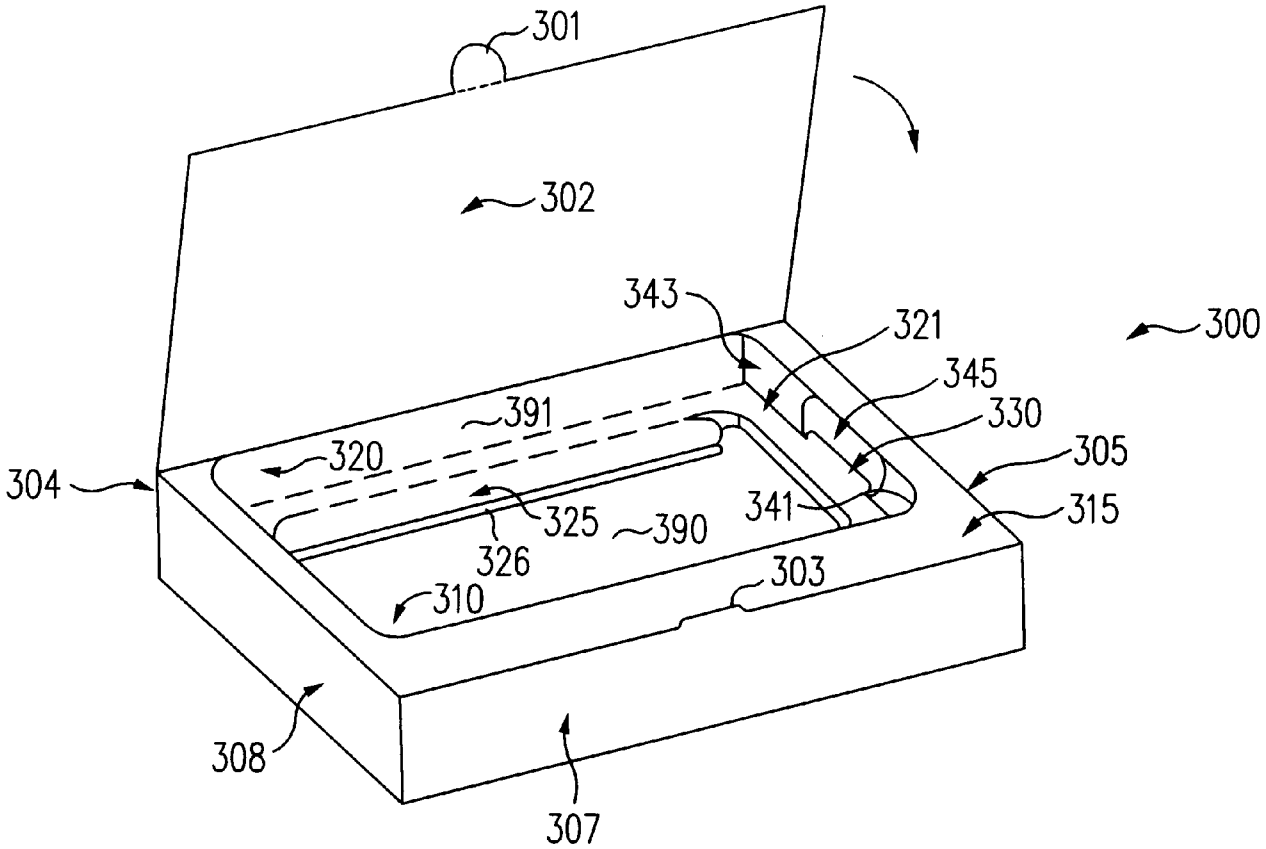
FIG. 3A is a perspective view of a one piece multiple compartment shipping and display box of this invention.

As illustrated in FIG. 3A, box 300 has two exterior end walls 308 and 305 that are removed from each other and that are substantially parallel. As explained more completely below, each of end walls 308 and 305 is made by making folds in the one piece of material, and then inserting a folded end tab extending from the end wall into box 300. Consequently, ends walls 305 and 308 may not be exactly parallel and so are said to be substantially parallel. Each of end walls 308 and 305 has an interior and an exterior surface.

Side walls 304, 315, 307, and 310 are substantially perpendicular to end walls 308 and 305. Each of side walls 304, 315, 307, and 310 has an interior and an exterior surface. Side walls 304, 315, 307 and 310 are also formed by making folds in the one piece of material. Consequently, side walls 304, 315, 307, and 310 may not be exactly perpendicular to end walls 308 and 305 and so are said to be substantially perpendicular. End walls 305 and 308, and side walls 304 and 307 extend from side wall 310, (See FIG. 3B), which in this embodiment is the bottom of box 300.

A channel-beam structure 341, that is described more completely below, has a vertical section 343 that forms an interior wall of box 300. Vertical section 343, which is an interior wall with first and second surfaces, is substantially parallel to and removed from end wall 305. A surface of channel-beam structure 341 in combination with interior surfaces of side walls 307 and 304 and an interior surface of end wall 305 defines an interior volume that is one of the end storage compartments.

Vertical section 343 includes an opening 345 that serves a dual purpose. First, opening 345 provides a window into the end storage compartment so that the purchaser can determine whether any parts are stored in the compartment. Second, opening 345 supports a tab 330 of shelf 321, e.g., shelf 321 is coupled to vertical section 343. In view of the dual function, opening 345 is sometimes referred to as a compartment viewing window and shelf tab support 345.

Figure 3B:
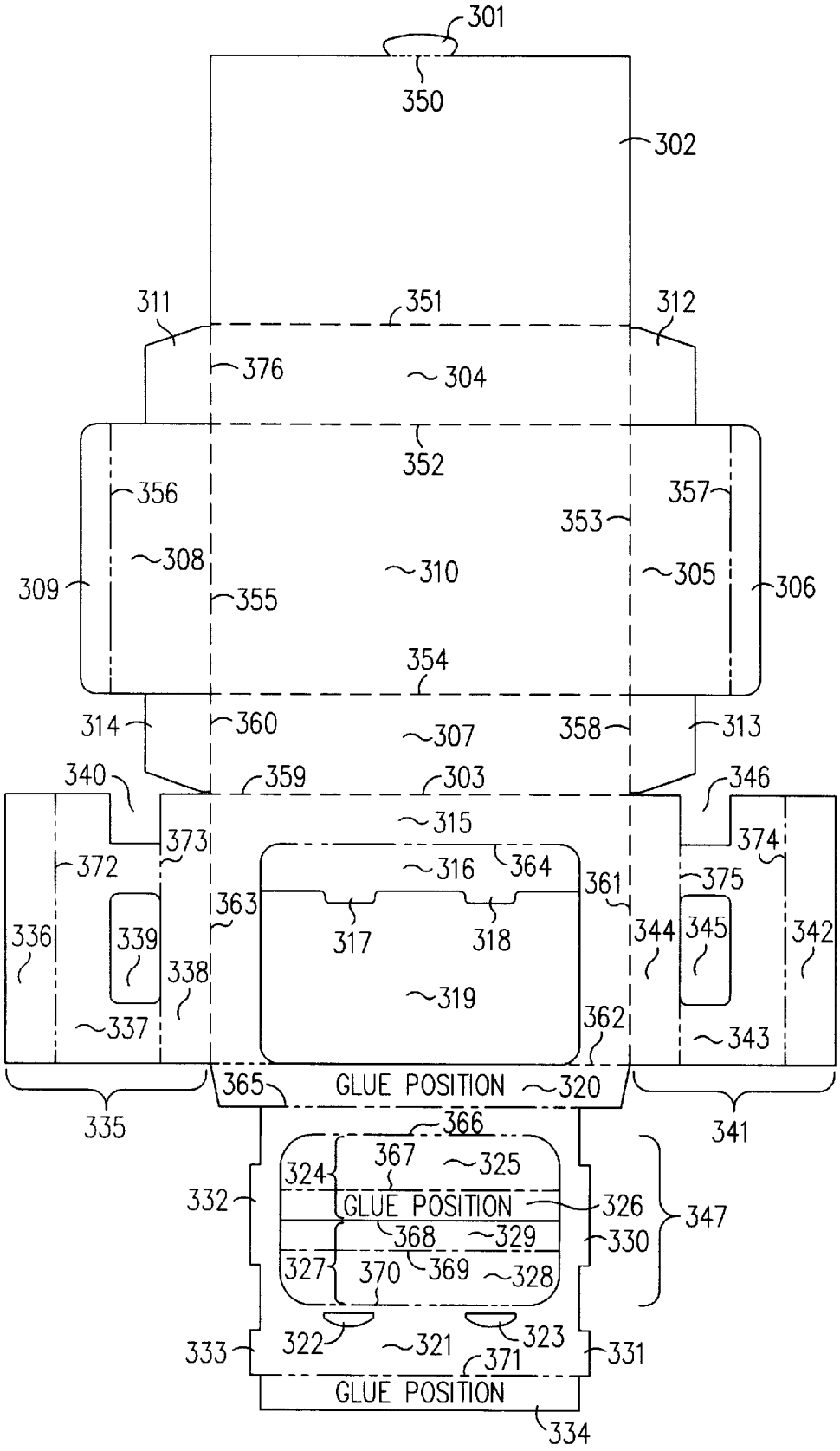
FIG. 3B is a flat cutout from which the box of this invention is made.

FIG. 3B is a plan view of a one piece of die-cut material that is used to construct box 300. In one embodiment, the material is 24 point solid bleached sulfate paper. In FIG. 3B, each of the edges of the box are illustrated along with the cut or perforations made along the edge. The cuts and perforations given in the key of FIG. 3B are illustrative only and are not intended to limit the invention to the specific cuts and perforations presented. In FIG. 3B, a solid black line represents a cut. A line made up of a long dash followed by two short dashes followed by a long dash represents a ⅜ inch cut followed by a ⅛ inch perforation. A line of short dashes represents a score. In one embodiment, edges 359, 363, and 361 are a double heavy score. The score and cut characteristics presented herein are illustrative only and are not intended to limit the invention to the particular embodiment disclosed. As is known to those of skill in the art, various combinations of scores, cuts, and scores and cuts can be used to obtain equivalent functionality to that disclosed herein.

Each of the features presented in FIG. 3B are described in more detail in conjunctions with the figures that follow which show how box 300 is constructed from the piece of material illustrated in FIG. 3B.

The order of steps in the following description was chosen to facilitate making drawings to go with the steps. The actual sequence of steps used in the manufacturer of box 300 will be based upon engineering trade-offs and choices associated with the equipment available for the assembly. Therefore, the sequence described more completely below is illustrative of only one of the many ways that box 300 could be assembled from the one-piece of material shown in FIG. 3B.

Figure 4B:
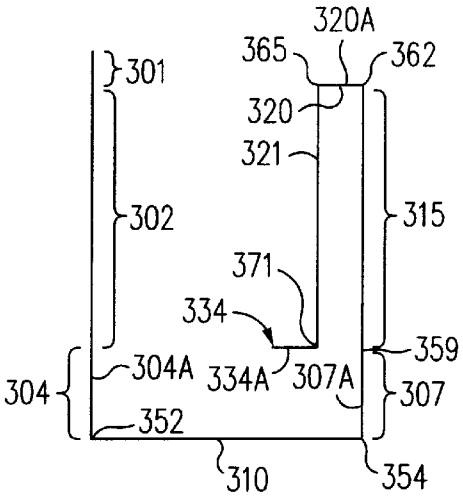
FIG. 4B is an end view of the perspective view of FIG. 4A taken along the line IVB.

To start construction of box 300 from the piece of material shown in FIG. 3B, side wall 304, and top 302 are folded along edge 352 so that wall 304 and top 302 are perpendicular to bottom 310, which is also a side wall. Side wall 307, side wall 315, first side stabilizer strip 320, shelf 321, and second side stabilizer strip 334 are folded along edge 354 to a position that also is perpendicular to bottom 310 (FIG. 4B).

Herein, if it is not specified that an element is folded, that element remains in the plane of the element to which it is attached. This convention is used to avoid repetitiously repeating all the various elements that are connected together, but that are not folded in the particular operation being described.

Figure 4A:
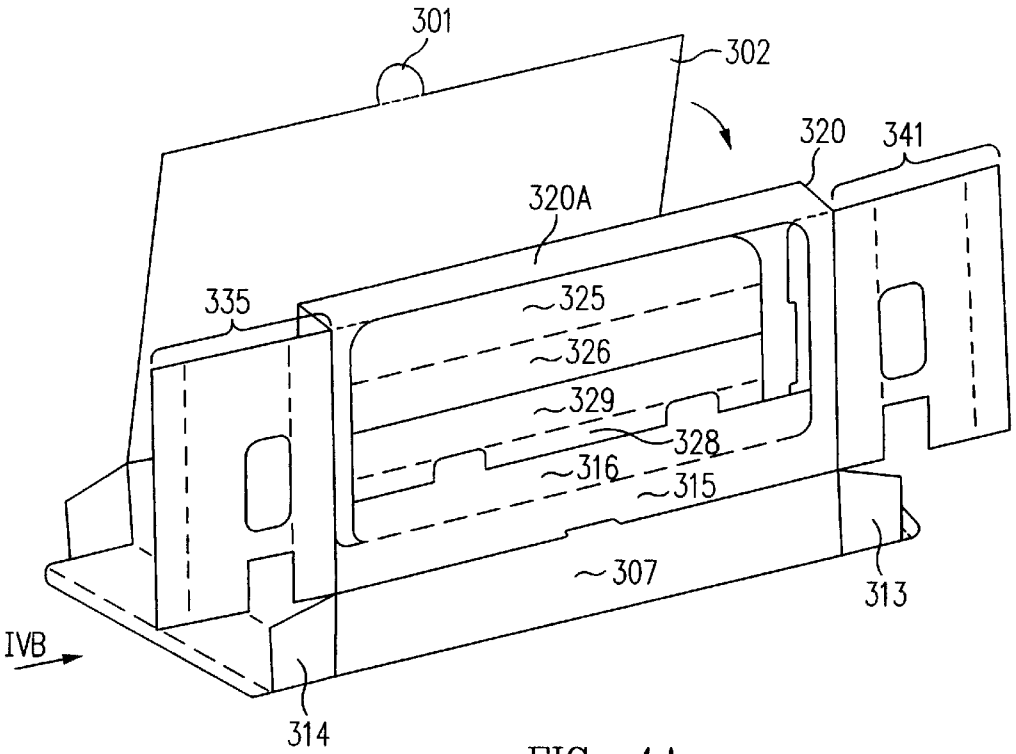
FIG. 4A is a perspective view that illustrates the box of this invention after a first set of folds.

After the fold along edge 354, first side stabilizer strip 320, shelf 321, and second side stabilizer strip 334 are folded along edge 362 to be perpendicular to side wall 315. Next, shelf 321 and second side stabilizer strip 334 are folded perpendicular to first side stabilizer strip 320 along edge 365 so that shelf 321 and side wall 315 are substantially parallel as shown in FIG. 4B. Finally, second side stabilizer strip 334 is folded perpendicular to shelf 321 and away from side wall 315 to arrive at the structure illustrated in FIGS. 4A and 4B.

Glue is placed on surface 320A of first side stabilizer strip 320, i.e., on the surface that will contact interior surface 304A of side wall 304. Glue is also placed on surface 334A of second side stabilizer strip 334 that will contact interior surface 307A of side wall 307.

Figure 5B:
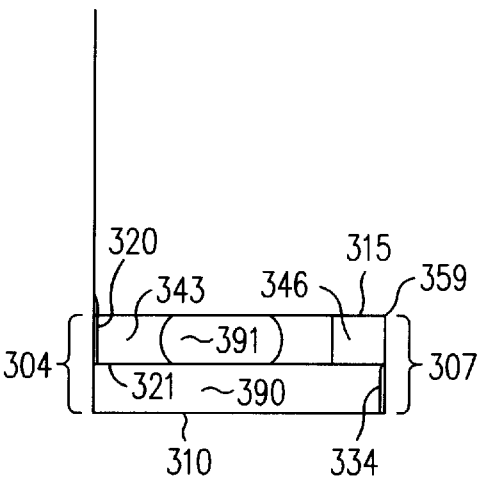
FIG. 5B is an end view of the perspective view of FIG. 5A taken along the line VB.
Figure 5A:
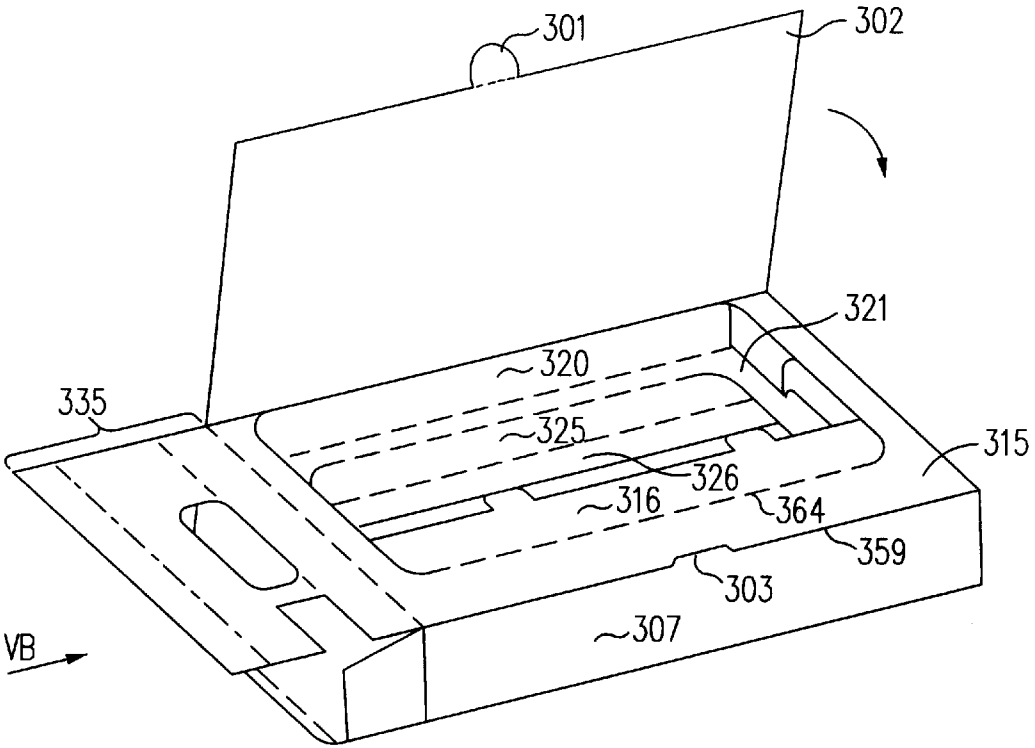
FIG. 5A is a perspective view that illustrates the box of this invention after a second set of folds.

After glue is applied to stabilizer strips 320 and 334, side wall 315 is folded perpendicular to side wall 307 along edge 359 so that strip 320 is glued to interior surface 304A of side wall 304 and strip 334 is glued to interior surface 307A of side wall 307 and thereby form the structure illustrated in FIGS. 5A and 5B. Hence, strip 320 is fixedly attached to side wall 304, and strip 334 is fixedly attached to side wall 307.

For convenience, in FIGS. 5A and 5B, channel-beam support structure 341 is folded into place along with side flaps 312 and 313 and end wall 305 with closure flap 306. Channel-beam support structures 335 and 341 are the same and so the steps necessary to accomplish these folds will apparent to those of skill in the art in view of the description of the folding of channel-beam support structure 335 presented below.

The gluing of strips 320 and 334 to side walls 304 and 307 gives box 300 structural stability in that box 300 cannot come apart. Also, the gluing is one of the aspects that helps to provide vertical rigidity to box 300.

Notice that as shown in FIG. 5B, two storage compartments 390 and 391 have been formed. In an embodiment, that did not require product positioning and box support structure elements 324 and 327, lower storage compartment 390 would have the shape shown in FIG. 5B. Therefore, compartment 390 of FIG. 5B is an alternative embodiment of a storage compartment of this invention.

Figure 6B:
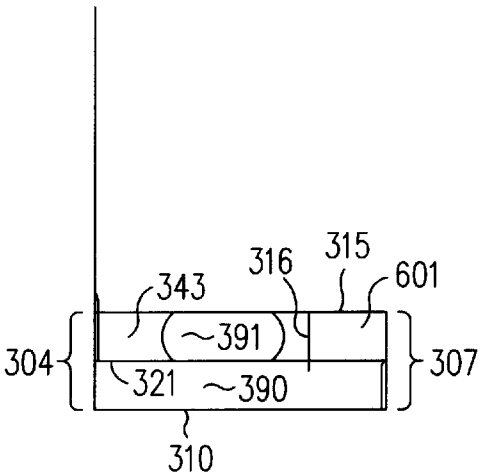
FIG. 6B is an end view of the perspective view of FIG. 6A taken along the line VIB.
Figure 6A:
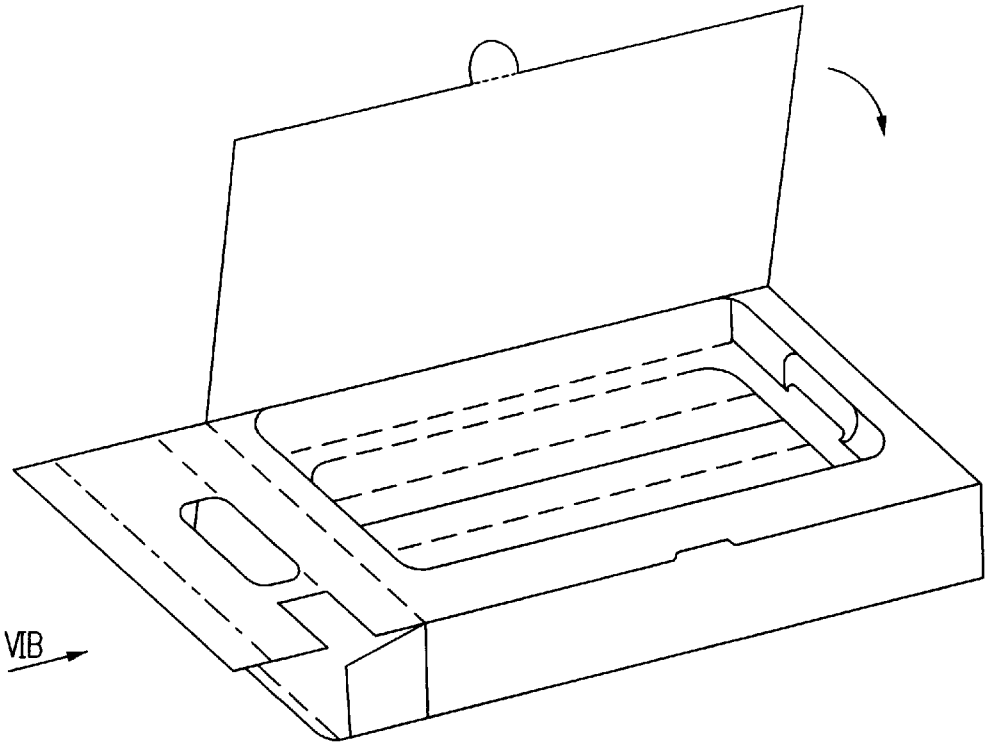
FIG. 6A is a perspective view that illustrates the box of this invention after a third set of folds.

After gluing strips 320 and 334 in place, box beam 601 is formed. Specifically, if it has not previously been done, piece 319 is removed to form an opening 319, and box beam side 316 is folded perpendicular to side wall 315 along edge 364. Box beam tab 317 is inserted into first box beam tab receiver 322 in shelf 321, that in this embodiment is an opening shaped to receive tab 317 and to hold tab 317 in place, and box beam tab 318 is inserted into second box beam tab receiver 323 that also is an opening shaped to receive tab 318 and to hold tab 318 in place. Hence, box beam side 316 is coupled to shelf 321. With box beam 601 constructed, (FIGS. 6A and 6B.) another potential storage compartment is defined, i.e., the interior of box beam 601. Also, box beam 601 adds strength to the front portion of box 300, and improves the overall rigidity of box 300. These factors are of importance because they allow box 300 to be constructed of a lighter weight material while still providing the strength and rigidity that is normally associated with a heavier weight material.

Figure 7B:
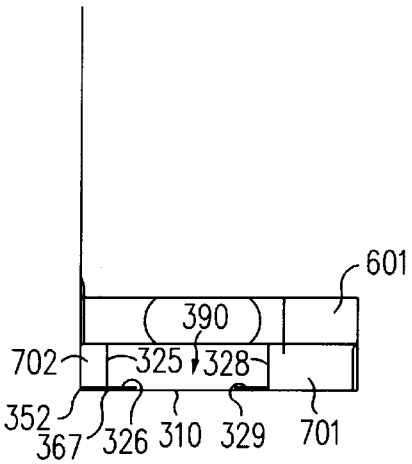
FIG. 7B is an end view of the perspective view of FIG. 7A taken along the line VIIB.
Figure 7A:
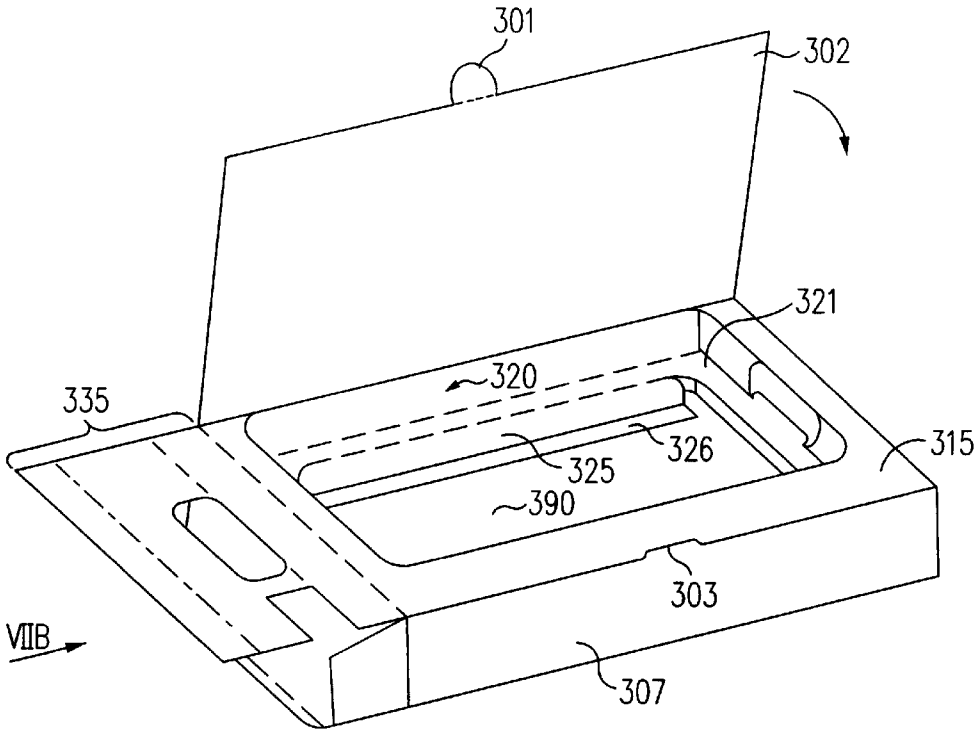
FIG. 7A is a perspective view that illustrates the box of this invention after a fourth set of folds.

After box beam 601 is formed, first and second product positioning and box support structure elements 324 and 327 are used to form box beams 701 and 702. (FIGS. 7A and 7B.) Specifically, box support structure stabilizer strip 326 is folded along edge 367 to from an angle with first product positioning strip 325. Glue is placed along a surface of strip 326 and then strip 325 is folded down along edge 366 until the glued surface of strip 326 contacts bottom 310 and forms a connection with bottom 310 and thereby forms box beam 702.

Similarly, box support structure strip 329 is folded along edge 369 to from an acute angle with second product positioning strip 328. Second product positioning strip 328 is folded along edge 370 until strip 329 approximately contacts bottom 310 to form a modified box beam 701. This defines the width of lower storage compartment 390 in the embodiment illustrated in FIG. 3A. In this embodiment, both strips 326 and 329 are visible in storage compartment 390 when looking down at box 300 from the top.

Strips 325 and 328 provide a friction contact with the electronic circuit board and in so doing stabilize the board in compartment 390. In addition, strips 325 and 328 provide shock protection for the circuit board. If a lateral impact is applied to box 310, strips 325 and 328 deform and thereby absorb the shock so that the full effect of the impact is not transmitted to the board. In addition, strips 325 and 328 provide a vertical component of support for box 300 and so provide some additional vertical rigidity.

Box beams 701 and 702 define additional compartments that could be used for storage. For example, a power cord could be placed in volume 701.

Figure 8B:
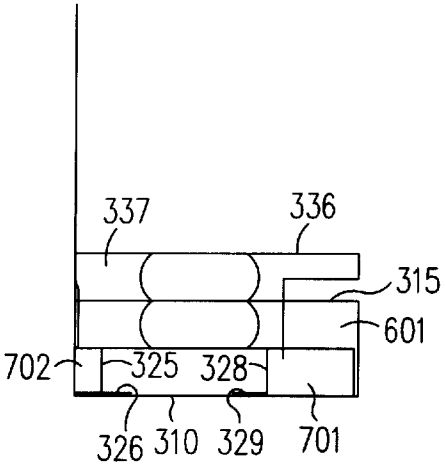
FIG. 8B is an end view of the perspective view of FIG. 8A taken along the VIIIB.
Figure 8A:
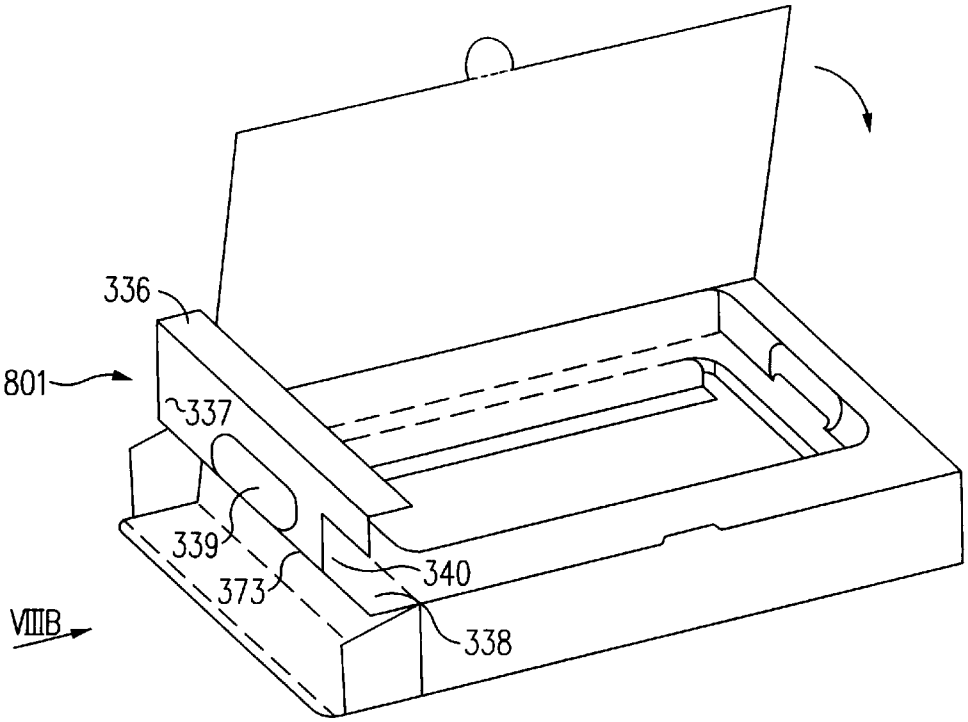
FIG. 8A is a perspective view that illustrates the box of this invention after a fifth set of folds.

Box 300 is nearly complete with the exception of forming the channel-beam structures and closing the end flaps. To start the formation of channel-beam structure 801, channel-beam vertical section 337 is folded-up and perpendicular to channel-beam top rail 338 along edge 373. Channel-beam bottom rail 336 is folded towards top 302 and perpendicular to channel-beam vertical section 337 to obtain the structure illustrated in FIGS. 8A and 8B.

Finally, channel-beam top rail 338 is rotated 180 degrees so that channel-beam top rail 338 is under and adjacent to exterior wall surface 315, and channel-beam bottom rail 336 is in contact with bottom 310. See FIGS. 9A and 9B. The formation of the channel-beam at the other end of the box is equivalent to that just described except structures 342, 343, and 344 along with edges 361, 375, and 374 are utilized.

Figure 9B:
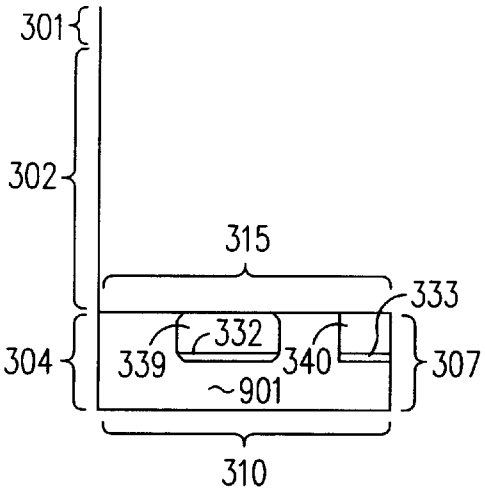
FIG. 9B is an end view of the perspective view of FIG. 9A taken along the line IXB.
Figure 9A:
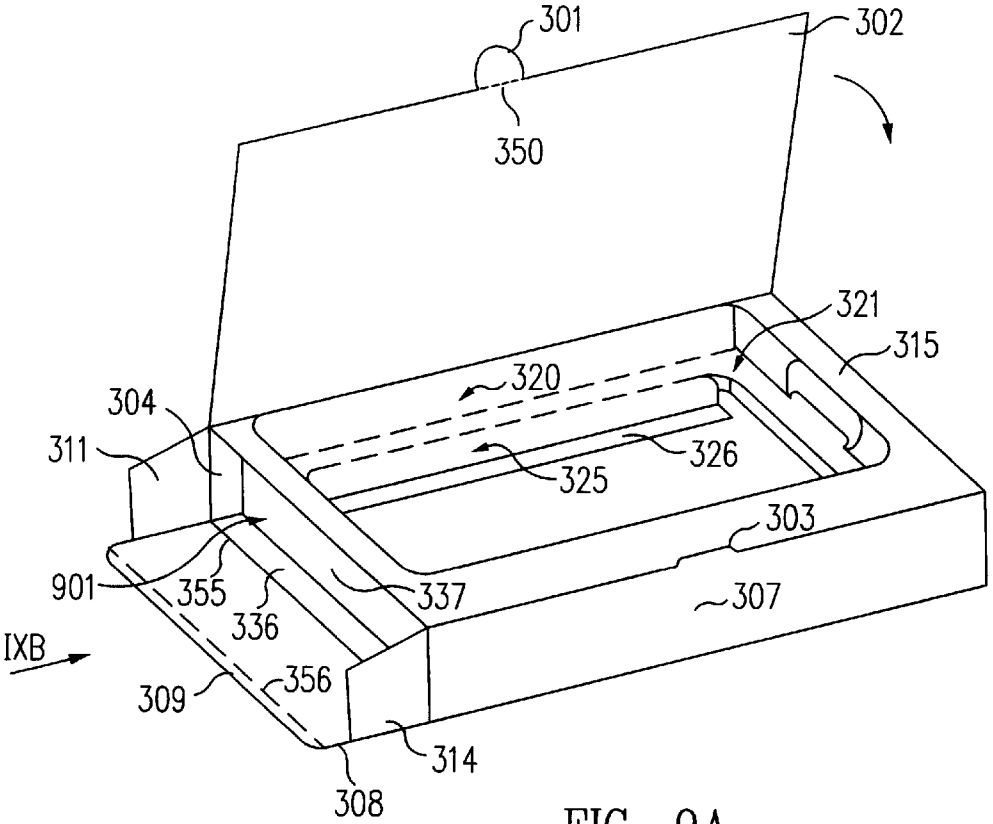
FIG. 9A is a perspective view that illustrates the box of this invention after a sixth set of folds.

As illustrated in FIGS. 9A and 9B, when channel-beam structure 801 is folded into box 300, another storage compartment 901 is formed. In addition, in this embodiment, opening 339 engages shelf tab 332 and opening 340 engages shelf tab 333. Thus, channel beam structure 801 is a multi-purpose structure. Channel-beam 801 supports an end of shelf 321. Channel beam 801 provides rigidity to box 300 and protects the electronic circuit board from impacts on the end of box 300. Channel beam 801 also helps to maintain the shape of box 300, and as noted bounds a storage area.

To complete box 300, flaps 311 and 314 are folded in along edges 376 and 360, respectively, so that flaps 311 and 314 are substantially perpendicular to side walls 304 and 307, respectively. Closure flap 309 is folded substantially perpendicular to end wall 308 along edge 356 and then end wall 308 is folded substantially perpendicular to bottom 310 along edge 355 and closure flap 309 is inserted into storage compartment 901. As described above, closure tab 301 can be folded along edge 350 and then top 302 folded along edge 351 as closure tab 301 is inserted into cut 303 to close the top of box 300.

Hence, box 300 has multiple storage compartments. Storage compartments 390 and 391 are oriented to provide the purchaser with easy and visible access to the parts placed therein. Windows are provided to the end storage compartment to permit the user to easily determine whether additional parts are stored in these areas. When the purchaser opens an end of box 300 to gain access to the end storage compartments, the user can see into box beam 601 and so determine whether anything is stored therein. Typically, volumes 701 and 702 are not used for storage because the volumes are not readily viewed by the purchaser.

Figure 10A:
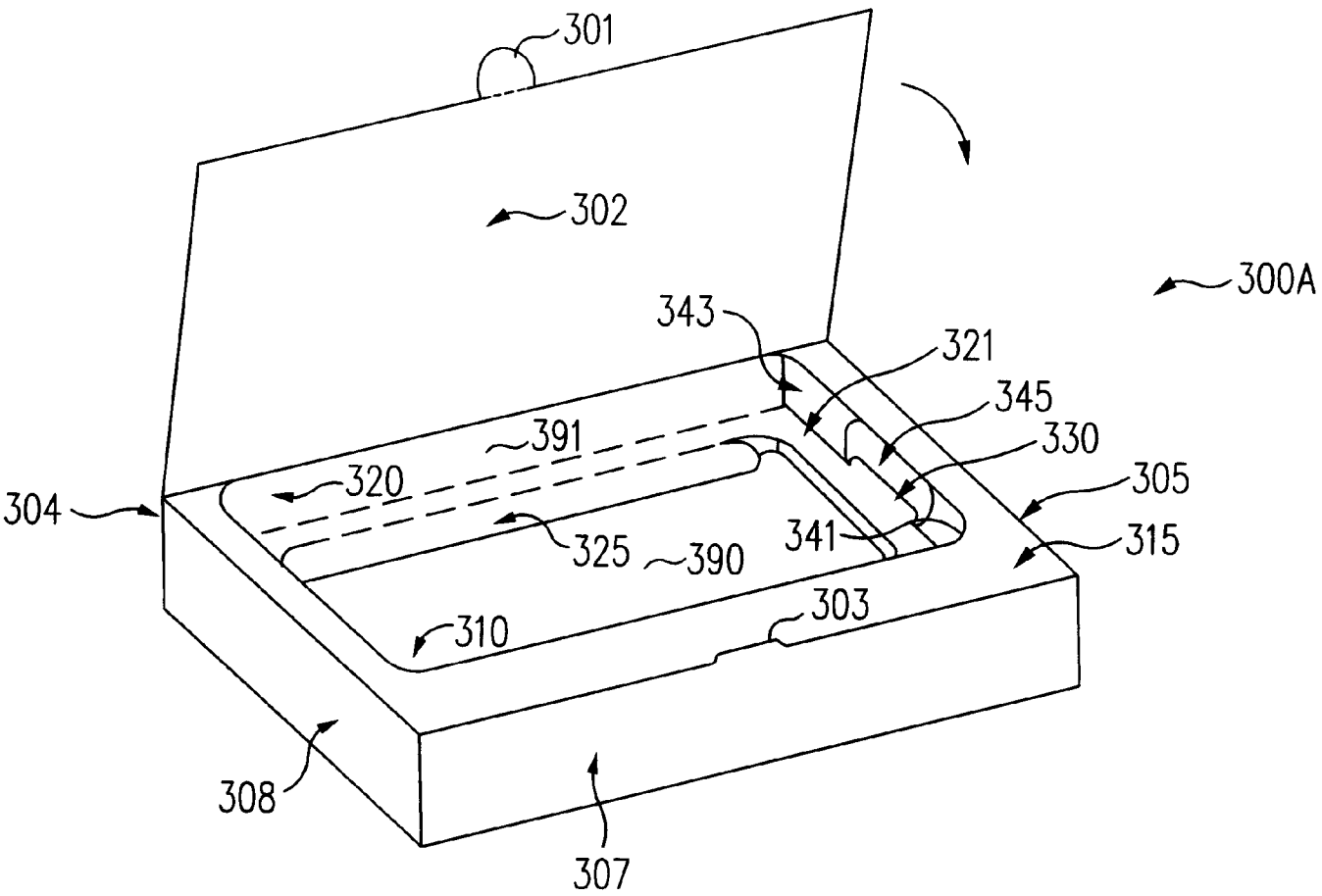
FIGS. 10A to 10C are an alternative embodiment of the box of this invention formed from the die cut-out of FIG. 3B.
Figure 10C:
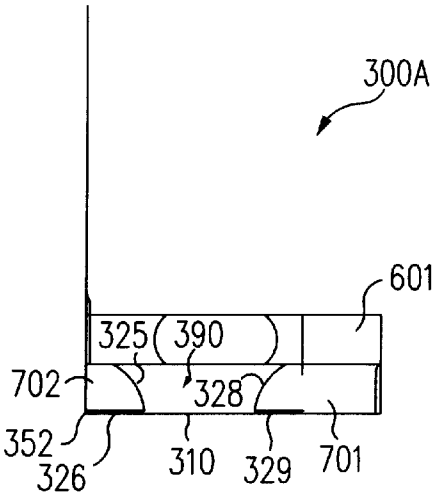
Figure 10B:
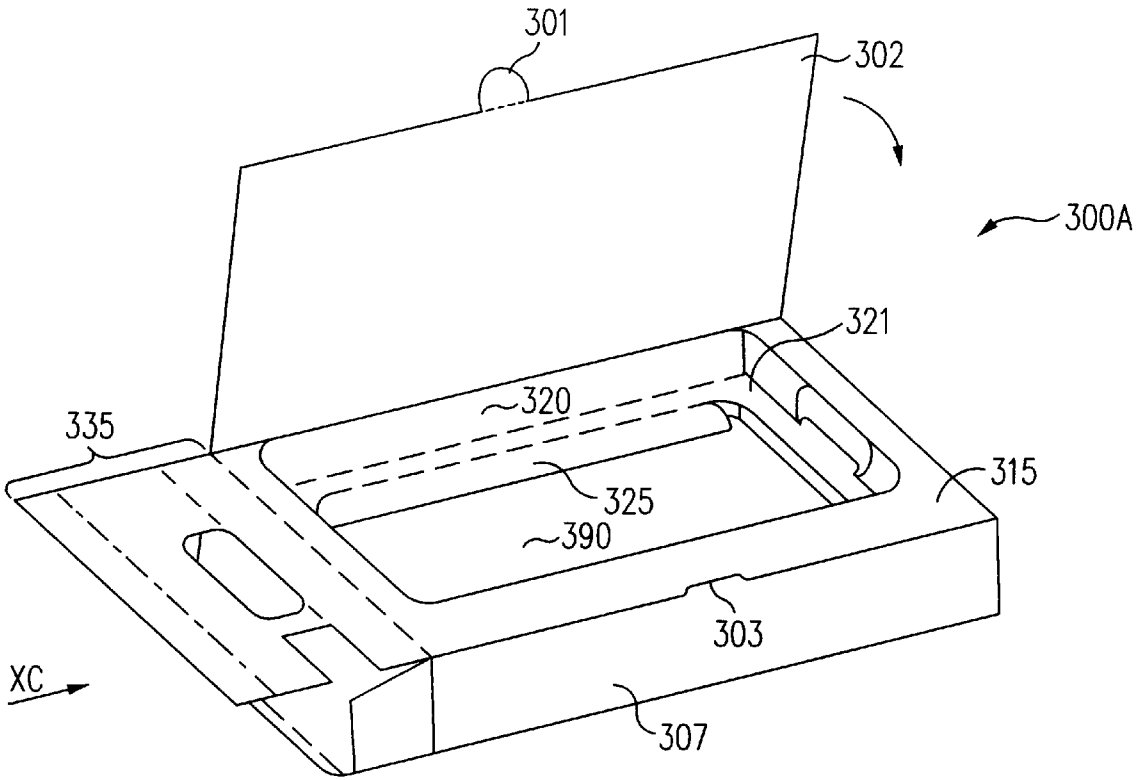

The embodiment of the invention described above is only illustrative of the principles of this invention and is not intended to limit the invention the specific embodiment disclosed. For example, as illustrated in FIGS. 10A to 10C, strips 326 and 329 are folded in an opposite direction to that illustrated in FIGS. 3A, 7A and 7B and an alternative embodiment of box 300 is obtained. All other features in FIGS. 10A to 10C are equivalent to those described above and so are not repeated. Thus, in view of this disclosure, those of skill in the art will be able to use the principles of this invention to form other one piece shipping and display boxes with multiple compartments.

I claim:

1. A one-piece container comprising:

a bottom;

a first side wall connected along a first edge to said bottom and substantially perpendicular to said bottom;

a second side wall connected along a second edge to said bottom and substantially perpendicular to said bottom;

an upper side wall connected along a third edge to said first side wall and substantially parallel to said bottom;

a first interior wall substantially perpendicular to said bottom, said first side wall, said second side wall and said upper side wall, said first interior wall extending between said bottom and said upper side wall;

a first exterior end wall connected along a fourth edge to said bottom, said first exterior end wall being substantially parallel to said first interior wall and extending between said bottom and said upper side wall, wherein a first storage compartment is defined by said bottom, said first side wall, said second side wall, said upper side wall, said interior wall and said exterior end wall;

a closure flap connected along a fifth edge to said first exterior end wall and substantially perpendicular to said first exterior end wall, said closure flap being inserted into said first compartment; and a shelf extending from said first interior wall, said shelf bounding the top of a second storage compartment, said shelf bounding the bottom of a third storage compartment, wherein said first, second, and third storage compartments are formed using only said one-piece.

2. The one-piece container of claim 1 further comprising:

a box beam side connected along a sixth edge to said upper side wall and perpendicular to said upper side wall, wherein said first side wall, said upper side wall, said box beam side and said shelf define a box beam.

3. The one-piece container of claim 2 wherein an interior volume of said box beam is a forth storage compartment.

4. The one-piece container of claim 3 wherein said forth storage compartment is visible from said first storage compartment.

5. The one-piece container of claim 1 further comprising a top rail, said upper side wall being connected to said interior wall by said top rail.

* * * * *